United States Patent [19]

Balzer et al.

[11] 4,104,839

[45] Aug. 8, 1978

[54] WALL PROTECTION ASSEMBLY

[75] Inventors: Claude P. Balzer; Edward M. Corman, both of Wichita, Kans.

[73] Assignee: Balco, Inc., Wichita, Kans.

[21] Appl. No.: 819,718

[22] Filed: Jul. 28, 1977

[51] Int. Cl.[2] ..... E04F 13/06; E04F 19/02

[52] U.S. Cl. ..... 52/288; 52/254; 52/281

[58] Field of Search ..... 52/288, 254, 461, 718, 52/281

[56] References Cited

U.S. PATENT DOCUMENTS

| | | | |
|---|---|---|---|
| 2,803,321 | 8/1957 | Fox-Williams | 52/464 |
| 2,963,825 | 12/1960 | Douglas, Jr. | 52/461 X |
| 3,594,028 | 7/1971 | Scott | 52/465 |
| 3,712,003 | 1/1973 | Hallock et al. | 52/254 |
| 3,717,968 | 2/1973 | Olsen et al. | 52/288 |

FOREIGN PATENT DOCUMENTS

| | | | |
|---|---|---|---|
| 927,569 | 6/1973 | Canada | 52/468 |
| 1,464,260 | 11/1966 | France | 52/718 |
| 2,217,548 | 10/1973 | Fed. Rep. of Germany | 52/254 |
| 1,191,501 | 5/1970 | United Kingdom. | |

*Primary Examiner*—Alfred C. Perham
*Attorney, Agent, or Firm*—Fishburn, Gold & Litman

[57] ABSTRACT

A wall protection assembly, for protecting an outwardly projecting corner of a building wall, includes a rigid base member having angularly disposed walls, each terminating in an outwardly extending abutment flange. The corner guard includes a semi-resilient guard member having a wall portion thereof, the wall portion having an inwardly extending flange on each side thereof for engaging the respective abutment flanges on the base member. The base member and guard member have interengaging portions adjacent the side thereof to retain the guard member on the base member with the guard member flanges engaging the abutment flanges of the base member. The abutment flanges contain any displacement or expansion of the guard member resulting from an impact thereto.

13 Claims, 7 Drawing Figures

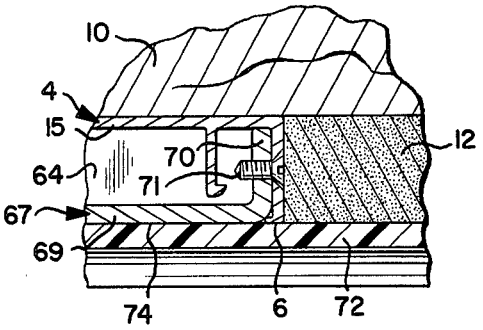
Fig. 7.
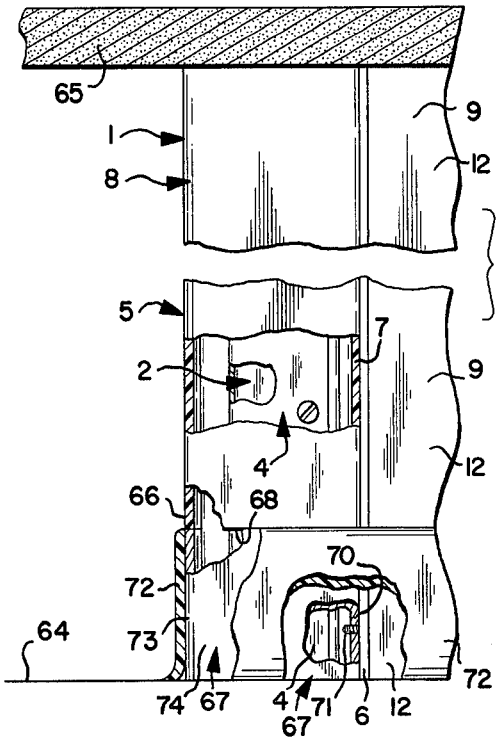
Fig. 6.
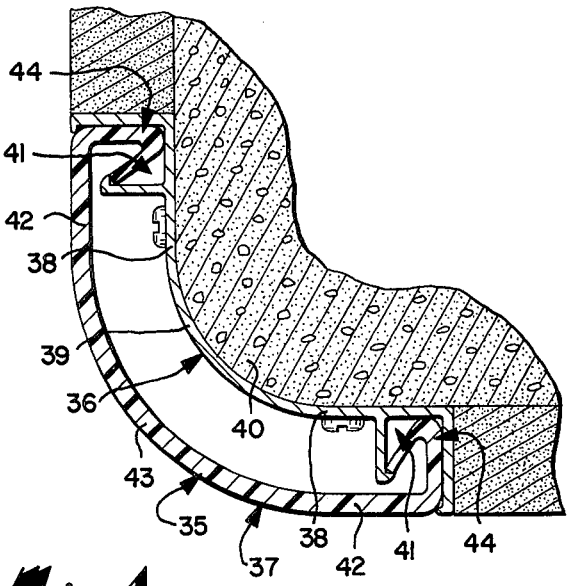
Fig. 4.
Fig. 5.
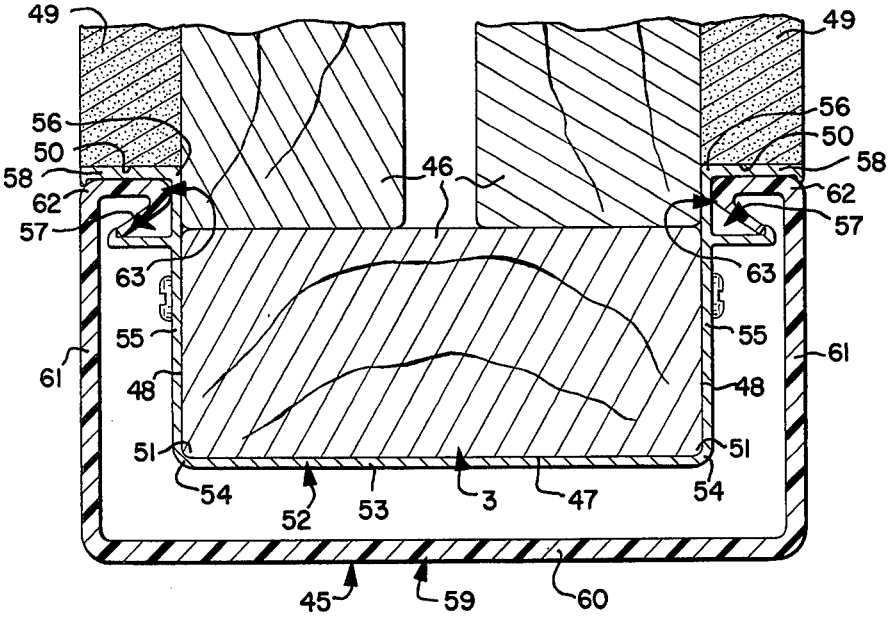

WALL PROTECTION ASSEMBLY

The present invention relates to corner guards and more particularly to a corner guard structure having a semi-resilient member with ends substantially fixed by positive abutment against a base member for protection of adjacent wall parts.

Outwardly protruding corners of building walls are vulnerable to damage from impact resulting from careless handling of various kinds of non-powered vehicles, for example, stretchers, wheel chairs, dining carts, and the like, in hospitals and elsewhere. Early attempts at protecting corners included metal angles fastened to the corners. However, these only afforded minimal protection, because a heavy impact was merely transferred to the structure underneath. Thin metal guards anchored to masonry walls and spaces filled with grout are common, but such guards dent and become unsightly in appearance, especially after absorbing a few collisions.

In more recent times, corner guards have been constructed using high impact, semi-resilient plastics together with metal mounting arrangements. The plastic guard member is spaced outwardly from the corner surfaces and side margins are movably mounted on mounting members, such that when impacted, the blow is partially dissipated in the flexure of the guard member and the movement of the side margins relative to metal mounting members. Such resilient corner guards have presented some problems, particularly with regard to complexity of installation. The edges of the resilient guard member are adapted for translating parallel to the adjacent structure wall during impact, requiring a slot or recess parallel to the wall. The recess requires that the outer wall panel or surfacing conform to the shape of the recess forming members. In the translating edge type of resilient corner guard, an inward stop is required to prevent the guard member from being released by excessive flexure by impact and to prevent manual removal thereof by vandals. The type of stop provided is a leaf spring projecting from the mounting member toward an offset portion near the edge of the guard member. Since the mounting member and the spring stop must be formed separately, then assembled, manufacturing costs are thereby increased.

The principal objects of the present invention are: to provide a resilient corner guard assembly that overcomes the disadvantages of the prior art by providing a more simplified structure that is easier to install and is highly resistant to removal after installation; to provide such a corner guard that protects a building wall corner from damage resulting from destructive engagement therewith; to provide such a corner guard assembly comprising a one-piece, rigid base member and a one-piece, semi-resilient guard member; to provide such a corner guard assembly in which the sides of the guard member are substantially fixed and any flex or shock from impact is transmitted to the base member; to provide such a corner guard assembly including positive abutments on the base member for containment of the guard member sides during impact protecting wall panels or surfaces therefrom; to provide such a corner guard assembly which may be installed on corners of building walls, both under construction and completed, with a minimum of alteration of the building wall parts; to provide such a corner guard assembly wherein the guard member is installed on the base member by pressing the side portions of the guard member into sockets provided on the base member; to provide such a corner guard assembly which has high resistance to tampering therewith; to provide such a corner guard assembly which may be cleaned easily; to provide such a corner guard assembly which conforms to prevalent fire and building codes; to provide a modification of such a corner guard assembly, adapted for protecting the end of a wall; and to provide such a corner guard assembly which is economical to manufacture, durable in use, attractive in appearance, and which is particularly well adapted for its intended purpose.

Other objects and advantages of this invention will become apparent from the following description taken in connection with the accompanying drawings wherein are set forth, by way of illustration and example, certain embodiments of this invention.

FIG. 4 is a view similar to FIG. 3 and illustrates a modified guard member and a modified base member, each having large radius wall portions.

FIG. 5 is a view similar to FIG. 3 and illustrates a modified wall protection assembly for protecting a wall end.

FIG. 6 is a fragmentary side elevational view of the wall protection assembly of FIG. 1 at a reduced scale with portions broken away and showing the assembly extending from a ceiling to a floor and including a kick plate section at the lower end thereof.

FIG. 7 is a fragmentary cross sectional view of the kick plate section showing means for fastening same to the base member.

Figure 1:
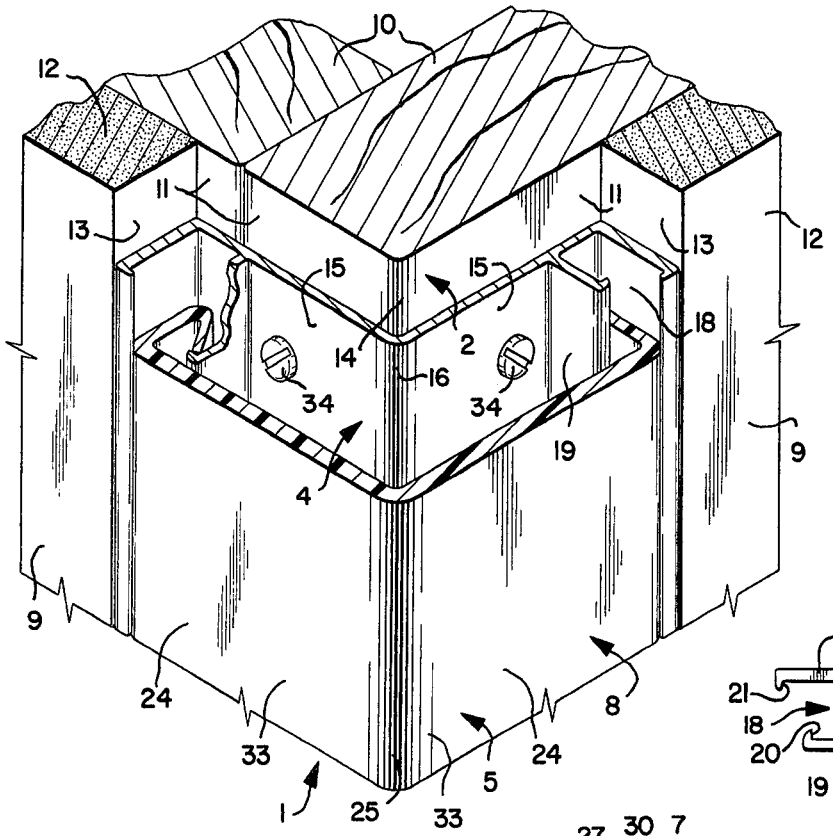
FIG. 1 is a fragmentary perspective view of the wall protection assembly installed on a building wall corner.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a wall protection assembly for protecting a portion of a building wall, such as a corner 2 or a wall end 3. The wall protection assembly 1 comprises, generally, a rigid base member 4 and a semi-resilient guard member 5 mounted thereon. The base member 4 includes abutment member or flanges 6 on opposite sides thereof, and the guard member 5 includes side members 7 on opposite sides thereof. The base member 4 and the guard member 5 each have interengaging means whereby the guard member 5 may be positioned and snapped into place on the base member 4.

Figure 2:
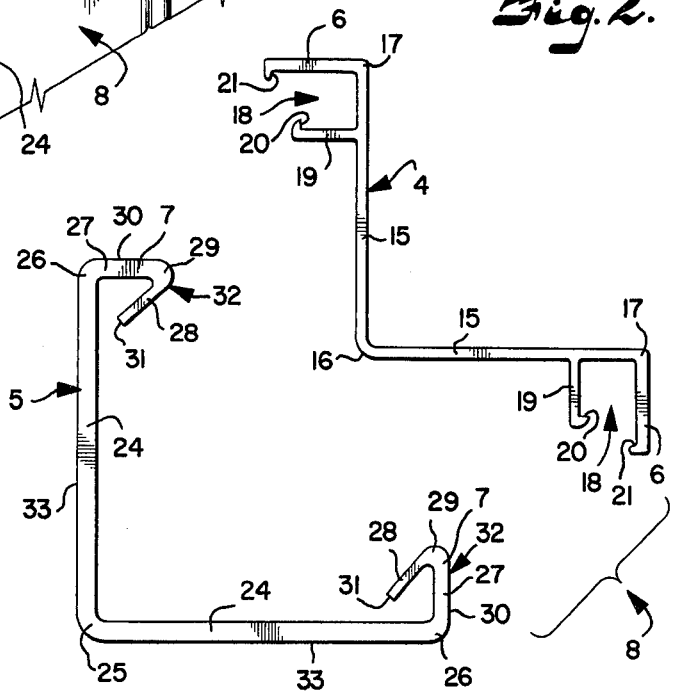
FIG. 2 is an end view of the base member and the guard member of the wall protection assembly shown disassembled.
Figure 3:
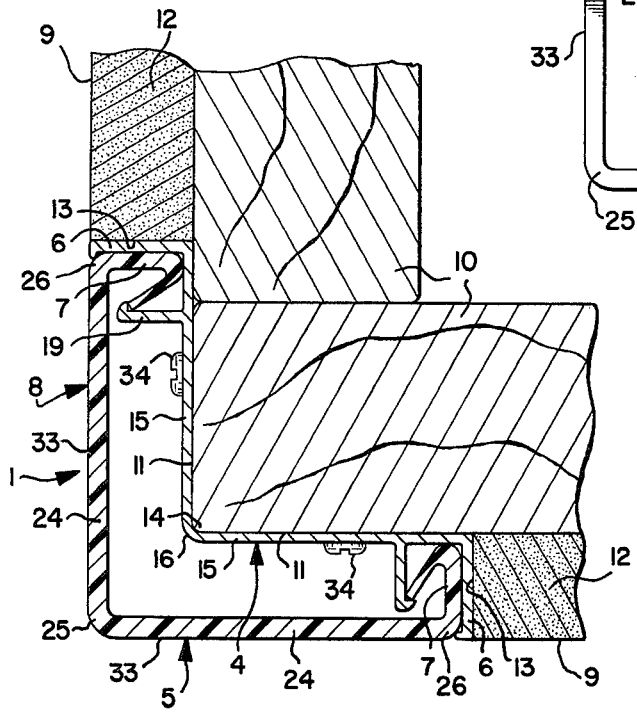
FIG. 3 is a transverse sectional view of the wall protection assembly installed on a building wall corner.

In the structure illustrated in FIGS. 1 through 3 the corner guard 8 is adapted for protecting the corner 2 from damage resulting from destructive engagement therewith, such as impacts, collisions, abrasions, or the like by carelessly handled hand carts, cleaning carts, stretchers, or other pushed vehicles. The corner guard 8 may be either surface or flush mounted, and in the illustrated structure is a flush installation wherein no parts of the corner guard 8 protrude past the outer surface 9 of the existing walls. Therefore, the corner guard assembly 8 may be used on any type of corner wall structure suitable for installation thereof.

FIGS. 1 and 3 illustrate a typical corner structure for which the corner guard 8 is well suited. The structure of the corner 2 includes support structure such as studs 10 having outer surfaces 11 thereof covered by finish panels or other wall covering 12, each panel having an end surface 13 thereof spaced from a corner vertex 14 to which the outer surfaces 11 converge. The finish panels 12 may be any type of wall covering, such as wood paneling, accoustic fiber board, plaster board, cast plaster, or the like. The end surfaces 13 are spaced from the corner vertex 14 according to the dimensions of the base member 4.

The base member 4 is rigid, elongated member and includes wall means of suitable contour and preferably conforming to the surface contour of the corner 2. In the embodiment illustrated in FIGS. 1 through 4, the base member 4 includes walls 15, each extending from a base member vertex 16 to a base member lateral edge 17. The base member 4 includes the abutment flanges 6 formed along each of the lateral edges 17 for engagement by the side members 7 of the guard member 5. The abutment flange 6 forms a guard member engaging means or socket 18 (see FIG. 2) at the lateral edge 17 with a rib 19 spaced from the respective lateral edge 17 toward the base member vertex 16. The abutment flanges 6 project outwardly from respective base member walls 15 at right angles thereto. The width of the abutment flanges 6 is equal to the thickness of the finish panels 12, such that the abutment flanges 6 provide protection for the end surfaces 13 of the finish panels 12. The ribs 19 are illustrated as projecting perpendicularly from respective base member wall 15; however, the angular relationship between a rib 19 and a respective wall 15 may vary from a right angle. The width of the ribs 19 from the base member is less than the width of the abutment flanges 6 from the base member to accomodate installation of the guard member 5. Each of the ribs 19 includes a shoulder 20 formed near the outer end thereof on a side facing toward a respective abutment flange 6. The shoulders 20 face toward respective base member walls 15. The abutment flanges 6 may include shoulders 21 at the extremities thereof, on sides thereof facing towards the base member vertex 16. The shoulders 21 also face toward respective base member walls 15.

The base member 4 is an integral member, and is preferably formed of metal. The member is particularly shaped to be formed by extrusion of aluminum or suitable materials. While the base member 4 is described and illustrated as an integral member it is to be understood that it could be fabricated and installed in sections. Further, while the base member 4 is illustrated with the base member walls 15 disposed at a right angle for a right angle corner, the walls 15 may be disposed at any reasonable angle to conform to a corner 2 having the surfaces 11 at a similar angular disposition.

The guard member 5 is an elongated, resilient covering member that is receivable on the base member 4 with the wall means of the guard member 5 in spaced relation to the walls 15 of the base member 4. In the embodiment illustrated in FIGS. 1 through 3, the wall means comprise guard member walls 24 disposed at an angle similar to that of the walls 15 of the base member 4. The walls 24 extend from a center portion 25 to opposite, external side edges 26 of the guard member 5. The guard member 5 includes the side members 7 formed along the external edges 26 thereof, and, as illustrated, each side member 7 includes an abutment wall 27 projecting inwardly from a respective guard member wall 24 at the respective side edge 26 thereof, and a resilient spring latch member 28 projecting from the inward edge 29 of the abutment wall 27 toward a respective wall 24 of the guard member. The abutment wall 27 includes an external surface 30, and the spring latch member 28 includes an abutment end 31 at the extremity thereof. The abutment walls 27, together with respective spring latch members 28, form longitudinally extending base member engaging means or plugs 32 along the side edges 26 of the guard member 5.

The abutment walls 27 each have a width such that when the guard member 5 is installed on the base member 4, the external surfaces 33 of the guard member 5 are flush with the outer surfaces 9 of the finish panels 12. The spring latch members 28 each have a width of slightly less than the diagonal distance from the junction of the abutment flange 6 with a respective wall 15 of the base member 4 to the shoulder 20 of an adjacent rib 19, for a purpose later described. The abutment wall 27 projects inwardly from the respective wall 24 of the guard member 5, preferably, at a right angle, while the spring latch member 28 projects from the inward edge 29 of a respective abutment wall 27 at an acute angle, preferably, less than 45°.

It is desirable for the guard member 5 to be resilient while at the same time resistant to damage by impacts and abrasions. Therefore, the guard member 5 is made of a tough, high impact plastic having limited resilience in the dimensions employed, such as a polycarbonate known commercially as "Lexan". In addition to the mechanical requirements of the guard member 5, it is desirable for the material thereof to be self extinguishing in the event of fire; and in hospital applications, it is desirable for the material to be non-porous for resistance to bacterial growth thereon. The material mentioned fulfills those requirements.

The guard member 5 is adapted to be formed by extrusion, or, formed to shape from flat sheets. The guard member 5 is decorative as well as protective and may be of various colors according to the decor of the installation and may include surface patterns formed thereon by rolling, embossing or other conventional processes.

The corner guard assembly may be installed on a corner 2 of a wall structure during construction thereof or installed on an existing wall structure. When possible it is preferable to install the base member 4 on the corner 2 before the finish panels 12 have been installed on the surfaces 11, and the guard member installed after installation of the panels 12.

The base member 4 is attached to the corner 2 with the walls 15 of the base member in covering relation to the exposed surfaces 11 of the studs 10, and with the abutment flanges 6 in covering relation to respective end surfaces 13 of the finish panels 12. The base member 4 is attached to the studs 10 by any suitable fasteners, such as screws 34 passing through the walls 15 of the base member 4. The walls 15 may either be pre-drilled with apertures (not shown) spaced vertically along the respective walls 15, or the walls 15 may be drilled at the time of installation.

The guard member 5 is installed on the base member 4 simply by pressing the plugs 32 all of the way into respective sockets 18 of the base member 4. One of the plugs 32 is aligned with a respective socket 18 and pressed in until the abutment edge 31 of a respective spring latch member 28 snaps past a shoulder 20 of a respective rib 19 of the base member. The procedure is repeated with the remaining plug and socket. Since the spring latch member 28 is at a smaller angle to its respective abutment wall 27 when installed, the spring latch member 28 is urged into its respective rib 19. When the guard member 5 has been installed on the base member 4, it is difficult to remove, since there is no way to pull the spring latch member 28 and its associated abutment end 31 out of contact with the shoulder 20 of its respective rib 19.

Installed, the corner guard assembly 8 provides effective protection for the corner 2 against damage thereto. Direct collisions to the corner 2 are absorbed partly by flexure of the guard member 5 and ultimately shielded from the stud 10 by the thickness of the guard member 5 together with the thickness of the base member walls 15. During such a collision, damage to the finish panel 12 by lateral translation of a guard member wall 24 during flexure is resisted by the abutment flanges 6. The corner guard assembly 8 is also effective in protecting the corner against less direct collisions and abrasions. The possibility of the guard member 5 being separated from the base member 4 during a collision is very remoted, as has been explained, since it is necessary to remove the abutment end 31 from contact with a respective shoulder 20 for removal of the guard member 5.

FIG. 5 illustrates a modified corner guard assembly 35 including a modified base member 36 and a modified guard member 37. The base member 36 includes walls 38 meeting at a relatively large radius center portion 39 and is suitable for installation on a corner 40 having a rounded surface with a radius equal to or greater than the radius of the center portion 39. The base member 36 includes a socket 41 on opposite sides thereof, the sockets 41 being identical to the sockets 18 of the base member 4. Installation of the modified base member 36 on the corner 40 is essentially the same as that described for the base member 4 on the corner 2.

While the guard member 5 could be mounted on the modified base member 36, FIG. 5 illustrates a modified guard member 37 mounted thereon. The guard member 37 includes walls 42 meeting at a large radius center portion 43. The guard member 37 includes plugs 44 on opposite sides thereof, the plugs 44 being identical to the plugs 32 of the guard member 5. The large radius guard member 37 could also be mounted on the base member 4. The procedure for mounting the guard member 37 on the base member 36, or a base member 4, is the same as described above for mounting the guard member 5 on the base member 4.

FIG. 6 illustrates a modification of the wall protection assembly 1, a wall end guard assembly 45, to provide protection for a wall end 3. The wall end 3 includes support structure, such as the studs 46 assembled as illustrated in FIG. 6 and presenting a wall end surface 47 and side surfaces 48 perpendicular thereto. The side surfaces 48 are covered by finish panels 49 having end surfaces 50 thereof spaced from respective corner vertices 51.

A modified base member 52 includes a center wall 53 having side edges 54 and side walls 55 joined to the center wall 53 at the side edges 54 thereof. The center wall 53 has a width to cover the wall end surface 47, and the side walls 55 are sized to extend from the corner vertices 51 to remote edges 56 of the modified base member 52. The modified base member 52 includes sockets 57, essentially identical to the sockets 18 described above, formed adjacent the remote edges 56 of the base member 52, including abutment flanges 58 at the remote edges 56.

The wall end guard assembly 45 includes a modified guard member 59 including a center wall 60 and side walls 61 joined thereto and having remote edges 62 thereof. The modified guard member 59 includes plugs 63, essentially identical to the plugs 32 described above, formed along the remote edges 62 of the guard member 59.

Installation of the modified base member 52 is similar to the installation of the mounting member 4, as described above. Installation of the modified guard member 59 on the base member 52 is essentially as described above for installation of the guard member 5 on the base member 4, whereby the plugs 63 of the wall end guard assembly 45 are snapped into the sockets 57 of the modified base member 52. The wall end guard assembly 45 is formed of the same types of materials as the corner guard assembly 8, and offers comparable protection for a wall end 3.

FIG. 6 illustrates the corner guard 8 installed on a corner 2 and extending from a floor 64 to or above a ceiling 65. Preferably, the lower end 66 of the corner guard 8 includes a rigid kick plate section 67 extending from the floor 64 to a lower end 68 of the guard member 5. The illustrated kick plate section 67 is formed of aluminum by extrustion and provides extra protection for the lower portion of the corner 2 from collisions by wheels of carts and the like.

The kick plate 67 is similar in cross sectional shape to the guard member 5 (see FIG. 7) having walls 69 similar to the walls 24 of the guard member 5 and side members 70 similar to the side members 7. The kick plate section 67 does not include or require a member similar to the spring latch member 28 because interengagement of the kick plate section 67 with the base member 4 is different from the interengagement of the guard member therewith.

The kick plate section 67 is positively attached to the base member 4 by fasteners and may be installed on the base member 4 before installation of the base member on the corner 2. The kick plate section 67 may be slid onto the base member 4 with the side members 70 in contact with the abutment flanges 6 and with the walls 69 in spaced relation to the walls 15 of the base member 4. The side members 70 are then attached to the abutment flanges 6 by passage of fasteners 71 through aligned apertures (not shown) drilled into the side members 70 and the abutment flanges 6. The fasteners 71 may be sheet metal screws, self-tapping screws, pop rivets or the like.

After installation of the base member 4, with the kick plate section 67 attached thereto, to the corner 2, a baseboard 72 may be installed. The baseboard 72 is a tough, resilient plastic member that protects the lower portions of the finish panels 12. The baseboard 72 is extended along, and in covering relation to, the lower portion of the finish panels 12 next to the floor 64 and may be wrapped around the corner vertex 73 of the kick plate section 67. Adhesive material is applied to the back of the baseboard 72 for bonding same in place.

Preferably, the kick plate section 67 and the baseboard 72 are equal in height above the floor 64 for a neat and coordinated appearance. Also, the external surfaces 74 of the kick plate section 67 are flush with the external surfaces 33 of the guard member 5 for the same reasons.

The kick plate section 67 may be suitably modified in cross section for use with the modified corner guard assembly 35 and with the wall end guard assembly 45. In such modifications, the kick plate section will have a cross section similar to the modified guard member 37 or the wall end guard member 59 respectively. Installation of the modified kick plate sections (not shown) with the modified assemblies 35 and 45 is essentially as described for the corner guard 8.

While certain forms of the present invention have been described and illustrated, it is not to be limited thereto except insofar as such limitations are included in the following claims.

What we claim and desire to secure by Letters Patent is:

1. A wall protection assembly for protection of a portion of a building wall intermediate of opposite boundaries thereof from damage resulting from impacts thereto comprising:

(a) an elongated, semi-resilient guard member having wall means and opposite side edges;

(b) longitudinally extending side members on each of said side edges and projecting inwardly therefrom with each having a laterally outward surface;

(c) an elongated base member having walls substantially conforming to the shape of the building wall portion to be protected and having side margins, said base member having outwardly projecting abutment members at each side margin with each having a laterally inward surface engaged by the respective lateral outward surface of the side members of the guard member for confining engagement of said guard member side members, said guard member wall means between the side members being in spaced overlying relation to said said base member walls;

(d) outwardly extending ribs on said base member walls and having shoulders facing the base member walls and spaced laterally inwardly from said abutment members; and (e) resilient flange means on said guard member adjacent each side member thereof with each said flange having an edge engaging the shoulder of the respective adjacent rib for retaining said guard member positioned on said base member with the side members of said guard member engaging respective abutment members of said base member and resisting lateral translation of said guard member relative to said abutment members on said base member.

2. A wall protection assembly as set forth in claim 1 wherein:

(a) said abutment members on the base member being abutment flanges projecting outwardly from said base member walls and extending along each of said base member side margins;

(b) said ribs each project outwardly from said base member walls and extend parallel to a respective abutment flange in spaced relation thereto;

(c) each said respective abutment flange and parallel rib having mutually facing surfaces, said mutually facing surfaces having base member wall facing shoulders thereon; and (d) said shoulders cooperating with a respective guard member and resilient flange means thereon to form interengaging means to lock said guard member on said base member.

3. A wall protection assembly as set forth in claim 1 wherein:

(a) said side members on the guard member are each an abutment wall projecting inwardly from each of said guard member wall means side edges, each of said abutment walls having an inward edge engaging the base member wall;

(b) said resilient flange means are each an integral, longitudinally extending spring latch member projecting from each of said abutment wall inward edges toward a respective adjacent portion of said guard member wall means, each of said spring latch members terminating in an end edge; and (c) each of said spring latch members forming a longitudinally extending plug with a respective abutment wall, said plug being engageable with a respective base member rib and shoulder thereof to maintain the inner edges of the guard member side members engaging the base member walls and each of said abutment wall external surfaces abutting a respective side abutment member of the base member.

4. A wall protection assembly as set forth in claim 1 wherein said portion of a building wall is a corner, said base member walls comprising a pair of elongated, planar wall portions joined at an angle to conform to said corner and each said planar wall portion extending to a respective abutment member.

5. A wall protection assembly as set forth in claim 4 wherein said corner includes a support structure having a pair of angularly disposed surfaces meeting at a corner vertex, said corner including a pair of finish panels, each panel being mounted on a respective support structure surface, having an end surface defining defining a respective boundary adjacent to and spaced from said corner vertex, and having a given thickness, and wherein:

(a) each of said base member planar wall portions has a width to extend from said corner vertex to a respective one of said boundaries; and (b) each of said outwardly projecting abutment members on the base member has a width equal to said finish panel thickness for protection of a respective finish panel end surface.

6. A wall protection assembly as set forth in claim 1 wherein said portion of a building wall is a wall end, said base member walls comprising:

(a) an elongated, planar end wall having a width to conform to said wall end and having opposite side edges; and (b) a pair of elongated, planar wall portions each joined perpendicularly to a respective one of said end wall side edges and extending therefrom and terminating in a respective outwardly projecting abutment member.

7. A wall protection assembly as set forth in claim 6 wherein said wall end includes a support structure having a front surface and a pair of side surfaces meeting said front surface at respective vertices, said wall end including a pair of finish panels, each panel being mounted on a respective support structure side surface, having an end surface defining a boundary adjacent to and spaced from a respective vertex, and having a given thickness, and wherein:

(a) each of said base member planar wall portions has a width to extend from a respective vertex to a respective boundary; and (b) each of said outwardly projecting abutment members has a width equal to said finish panel thickness for protection of a respective finish panel end surface.

8. A corner guard assembly for protecting an outwardly projecting corner of a building from damage resulting from impacts thereto, said corner including a wall support structure having a pair of angularly disposed surfaces meeting at a corner vertex, said corner including a pair of finish panels, each panel mounted on a respective support structure surface, having an end surface, and having a given thickness, said corner guard assembly comprising:

(a) an elongated rigid base member having a paid of walls disposed at an angle equal to said support structure surface angular disposition, said base member walls each having a free lateral edge;

(b) said base member including longitudinally extending outwardly opening socket means integral with said base member walls and adjacent said lateral edges thereof;

(c) each of said socket means including an outwardly extending abutment flange;

(d) said base member being attached to said wall support structure with each of said base member walls overlaying a portion of a respective support structure surface, and with each of said abutment flanges substantially engaging and protecting a respective finish panel end surface;

(e) an integral, elongated, semi-resilient guard member having wall means with side edges thereon;

(f) inwardly projecting and longitudinally extending plug means integral with said guard member wall means and adjacent each of said side edges thereof;

(g) said plug means having outwardly facing edges and said socket means having inwardly facing shoulders;

(h) said guard member being mounted on said base member with said guard member wall means being spaced outwardly and in overlying relation relative said base member walls and with each of said plug means being received in a respective socket means and the edges of the plug means and shoulders of the socket means interengaged for retaining the guard means on the base member.

9. A corner guard assembly as set forth in claim 8 wherein said socket means comprises:

(a) each of said abutment flanges having a shoulder spaced outwardly from a respective base member wall, said abutment flange shoulders each facing inwardly toward said respective base member wall;

(b) each of said base member walls having a longitudinally extending rib projecting outwardly therefrom in spaced relation to a respective abutment flange, each of said ribs having a shoulder facing a respective base member wall formed on a surface facing toward a respective abutment flange; and (c) each of said longitudinally extending socket means being formed with a rib and a respective abutment flange for locked retention of a respective guard member plug means to secure the guard member to the base member with the abutment flanges preventing laterally outwardly translation of the guard member.

10. A corner guard assembly as set forth in claim 9 wherein said plug means comprises:

(a) a longitudinally extending abutment wall projecting inwardly from each of said guard member side edges, said abutment walls each having an external surface and an inward edge;

(b) an integral, longitudinally extending and resilient latch member wall extending from said inward edges toward a respective adjacent portion of said guard member wall means, each of said latch member wall terminating in an end edge; and (c) each of said latch member wall and respective abutment wall forming one of said longitudinally extending plugs, each said plug being received in a respective socket means for locked and laterally non-translatable retention therein and with each of said abutment wall external surfaces abutting a respective base member abutment flange.

11. A wall protection assembly for protection of a portion of a building wall from damage from impacts thereto comprising:

(a) an integral, elongated, rigid base member having walls substantially conforming to the surface contour of a portion of a building wall to be protected, said base member including opposite lateral edges;

(b) an integral, elongated, semi-resilient guard member having wall means and opposite side edges;

(c) guard member engaging means extending longitudinally along each of said base member lateral edges and including a longitudinally extending rigid abutment flange projecting outwardly from a respective base member wall at a respective base member lateral edge, each of said abutment flanges having a shoulder formed on a surface facing away from a respective base member lateral edge, said shoulders facing respective portions of said base member walls;

(d) a pair of longitudinally extending ribs projecting from said base member walls, each of said ribs being in spaced relation to a respective abutment flange, each of said ribs having a shoulder on a surface facing toward a respective base member wall lateral edge, said rib shoulders facing respective portions of said base member walls, each of said ribs forming a longitudinally extending socket with a respective abutment flange;

(e) base member engaging means extending longitudinally along each of said guard member wall means side edges; and (f) said guard member being mounted on said base member with each of said base member engaging means received in respective sockets formed by said ribs and abutment flanges in locked engagement and laterally non-translatable retention therein, with respective portions of said guard member wall means being in outwardly spaced overlying relation to said base member walls.

12. A wall protection assembly as set forth in claim 11 wherein said base member engaging means comprises:

(a) a longitudinally extending abutment wall projecting inwardly from each of said guard member wall means side edges, each of said abutment walls having an inward edge and an external surface;

(b) an integral, longitudinally extending and resilient spring latch member projecting from each of said abutment wall inward edges toward a respective adjacent portion of said guard member wall means, each of said spring latch members terminating in an end edge; and (c) each of said spring latch members forming a longitudinally extending plug with a respective abutment wall, said plug being received in said respective socket for locked and laterally non-translatable retention thereof and with each of said abutment wall external surfaces abutting a respective abutment flange.

13. An impact absorbing protector arrangement for a wall structure normally vulnerable to abuse by external impacting, including:

(a) an underlying structural part located at the vulnerable portion;

(b) an elongate rigid base member having wall portions substantially conforming to the exterior shape of said wall structure, said base member being secured to said wall structure, said base member wall portions having laterally spaced side walls integral with and extending outwardly from said wall portions;

(c) a rib member integral with said wall portions and extending outwardly therefrom adjacent to and spaced from a respective side wall, said ribs having shoulders extending toward the adjacent side wall, each said shoulder being spaced from and facing a respective wall portion;

(d) an elongate semi-resilient guard member having a central portion located in spaced overlying relation to the base member wall portions, said guard member central portion having integral inwardly extending side flanges with laterally outward surfaces in abutting engagement with inner surfaces of said base member side walls preventing lateral outward translation of said guard member side flanges;

(e) means securing the guard member to the base member including laterally inwardly extending shoulder means on the guard member side flanges engaging the shoulders on said ribs to retain the guard member on the base member and prevent outward movement of said guard member relative to said base member; and (f) said side flanges engaging said base member wall portions to limit movement of the guard member toward said base member, the semi-resilient guard member central portion defining an exposed surface protecting underlying wall structure from marring and deterioration by impacting.

* * * * *